367-93 SR
2/19/80 XR 4,189,719

United States Patent [19]

Massa et al.

[11] 4,189,719

[45] Feb. 19, 1980

[54] INTRUSION ALARM SYSTEMS

[75] Inventors: Donald P. Massa, Cohasset; James G. Hall, Weymouth, both of Mass.

[73] Assignee: The Stoneleigh Trust, Cohasset, Mass.

[21] Appl. No.: 834,644

[22] Filed: Sep. 19, 1977

[51] Int. Cl.[2] ..... G08B 13/16

[52] U.S. Cl. ..... 340/501; 340/149 R; 340/164 R; 340/528; 367/93

[58] Field of Search ..... 340/214, 410, 258 A, 340/276, 274 C, 63, 64, 65, 528, 541, 543, 164 R, 149 R, 501; 361/172

[56] References Cited

U.S. PATENT DOCUMENTS

| | | | |
|---|---|---|---|
| Re. 29,259 | 6/1977 | Sabsay | 340/149 R |
| 3,408,642 | 10/1968 | Palladino | 340/164 R |
| 3,544,987 | 12/1970 | McMann et al. | 340/276 X |
| 3,609,738 | 9/1971 | Marte | 340/164 R |
| 3,659,154 | 4/1972 | Finn | 340/543 X |
| 3,688,293 | 8/1972 | Sullivan | 340/416 X |
| 3,755,776 | 8/1973 | Kotras | 340/543 X |
| 3,778,770 | 12/1973 | Hagendoorn et al. | 340/149 R |
| 3,838,408 | 9/1974 | McMaster | 340/258 A |
| 3,846,782 | 11/1974 | Brodsky | 340/501 |
| 3,848,229 | 11/1974 | Perron et al. | 340/149 R |
| 3,858,192 | 12/1974 | Fischer | 340/214 X |
| 4,006,460 | 2/1977 | Hewitt et al. | 340/276 X |
| 4,021,796 | 5/1977 | Fawcett et al. | 340/501 X |
| 4,050,063 | 9/1977 | Schull | 340/274 C |
| 4,114,147 | 9/1978 | Hile | 340/543 X |

*Primary Examiner*—David L. Trafton

[57] ABSTRACT

An intrusion alarm system includes a microcomputer and keyboard for providing control functions for the alarm system with greater reliability and with greatly increased security as compared with prior art systems. The disclosed system provides a positive means for deactivating the alarm system only by authorized personnel by the use of a multi-digit code which must be correctly entered on the keyboard within a prescribed short period of time after entry into the protected zone. Upon entry into the protected zone, the system goes immediately into a preliminary alarm stage which, for example, may be the lighting of a floor lamp in the room. The person entering the premises then has thirty seconds to enter the correct code on the keyboard attached to the front panel of the alarm unit to deactivate the system. If an unauthorized person enters and cannot provide the required code, the system enters the final alarm stage which turns on the automatic dialer to notify the police and also turns on auxiliary sirens, outdoor lights, and any other alarm outputs that may be desired.

8 Claims, 3 Drawing Figures

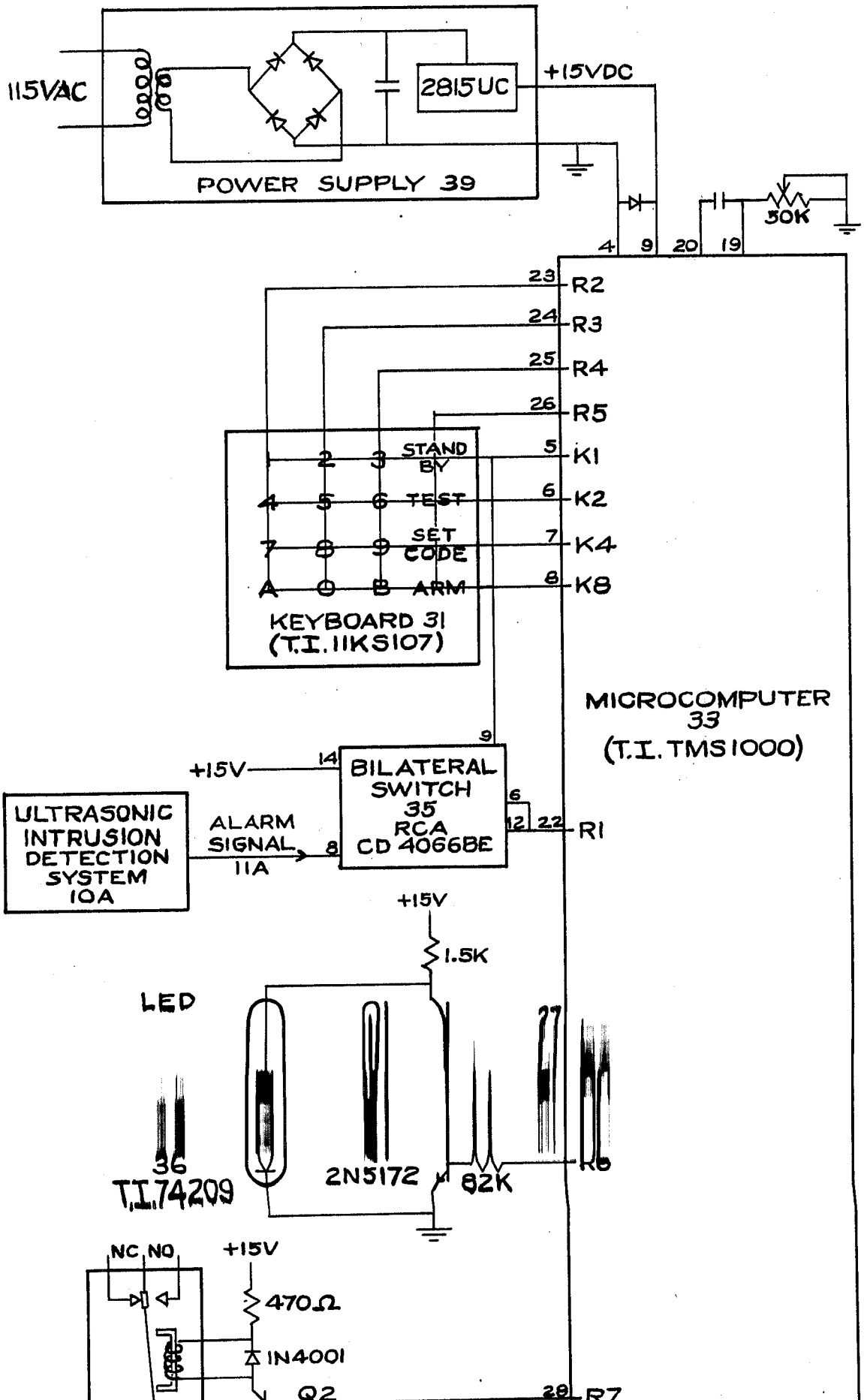
115VAC
2815UC
+15VDC
POWER SUPPLY 39
50K
4
9
20
19
23
R2
24
R3
25
R4
26
R5
STAND BY
TEST
SET CODE
ARM
5
K1
6
K2
7
K4
8
K8
KEYBOARD 31
(T.I. 11KS107)
MICROCOMPUTER
33
(T.I. TMS1000)
+15V
14
BILATERAL SWITCH
35
RCA
CD 4066BE
9
6
12
22
R1
ULTRASONIC INTRUSION DETECTION SYSTEM 10A
ALARM SIGNAL 11A
8
+15V
1.5K
LED
36
T.I. 74209
2N5172
82K
27
R6
NC NO
+15V
470Ω
IN4001
Q2
28
R7

INTRUSION ALARM SYSTEMS

This invention relates to improvements in surveillance systems, including improved means for activating and deactivating the alarm system after it is installed, whereby increased system security and reliability is achieved over the prior art and also greater ease of installation and operation is advantageously realized for the disclosed invention.

There are many types of intrusion detection systems in general use that are well known in the art. Some types of perimeter surveillance systems provide protection for a designated area by means of electrical switches installed near doors and windows so that if a door or window is opened, the associated electrical switch changes state, thereby activating the alarm system. Other types of perimeter protection systems employ pressure-activated switches under floor mats, or invisible light beams across entrances in the well-known manner for activating the alarm system when an intruder steps on the mat or intercepts the light beam.

More sophisticated types of intrusion alarm systems employ motion detectors that sense the movement of an intruder within the area or room being protected. A common type of motion detection system which is in general use is the ultrasonic intrusion alarm system whose operation depends on the detection of the change in the acoustic characteristics of an ultrasonic sound field within a designated area due to the presence of a moving target within the area. Many types of ultrasonic alarm systems have been in widespread use for many years. A review of the prior art systems are presented in U.S. Pat. Nos. 3,828,326 and 3,967,260, and U.S. patent application Ser. No. 683,548, filed May 5, 1976 now U.S. Pat. No. 4,107,659.

All intrusion alarm systems, whether they be perimeter systems employing switches or floor mats, or whether they be motion detectors employing ultrasonic sound or microwaves, must have control means for permitting authorized personnel to activate and deactivate the system. The most common control method for activating and deactivating an alarm system at the present time is by means of a key-operated electrical switch which is usually placed outside of the zone of detection. For example, if the zone of protection is a home, the switch may be placed at the front door, so that upon leaving the house, the owner conveniently arms the alarm system with his key and likewise deactivates the system upon returning. The electrical key switch is usually located in the circuit between the intrusion sensing device, such as the ultrasonic motion detector, and the alarm reporting devices, such as horns, bells, or automatic telephone dialers. When the system is deactivated by the key switch, the alarm signal generated by the intrusion detection system, upon entry in the protected area, is prevented from activating the alarm reporting devices.

The use of key switches have several inherent disadvantages, including the relative ease for tampering with the switch as well as the ease for unauthorized duplication of the key, and the inconvenience of having the locks replaced every time a key is lost. Key switches may be easily by-passed electrically, in which case an intrusion will not activate the alarm reporting device. Alarm systems generally provide several different modes of operation, in which case additional switches are required to permit multimode selection which adds to the cost of the conventional system.

The present invention overcomes the limitations of the prior art systems by replacing the key switch required for arming and deactivating the system, and also by replacing additional switches required for the multimode operation of the alarm system by an electronic system employing a keyboard and microcomputer. Applicants' inventive system provides means for arming and deactivating an alarm system with an electronic code which can be entered into the electronic memory of the system through a keyboard similar to those used on conventional touch-tone telephones or hand-held calculators. By substituting a multi-digit code for the conventional key-operated switch, as used in prior art systems, Applicants' system cannot be deactivated except by re-entering the identical multi-digit code which was previously entered into the electronic memory.

The use of an electronic keyboard in combination with a microcomputer, as will be described, also permits the use of the same keyboard to activate all other modes of operation of the system, such as, for example, placing the system into the TEST mode or STANDBY mode. The recent advances in the state of the art of large-scale integrated circuits and, particularly, the advances in the field of microcomputer technology have now made it relatively inexpensive to build systems incorporating the teachings of this invention to greatly improve the operation and reliability of security alarm systems and also to simplify their installation. Additional advantages of the present invention over the prior art will become evident in the description of the invention which follows.

A primary object of this invention is to provide an improved method for controlling the operation of an electronic security system.

Another object of this invention is to provide an improved method for arming and deactivating an intrusion alarm system for increasing the reliability of the system in protection against intrusion.

Still another object of this invention is to provide an electronically coded switching means for arming and deactivating an alarm system in which the code can be instantly changed at will whenever desired.

A further object of this invention is to increase the detection reliability of an intrusion alarm system by making it virtually impossible to deactivate or breach the security of the system by an intruder.

Another object of this invention is to provide an improved electronic control means for operating an intrusion detection system which includes a multi-digit keyboard and a microcomputer programmed to respond to the use of the keyboard for setting a unique code by pressing the keys for a sequence of digits to which the alarm system will uniquely respond when it is required to deactivate the system upon entry by an authorized person.

A still further object of this invention is to provide in the improved electronic control means an additional instruction in the memory of the microcomputer that limits the time within which the correct unique code must be entered on the keyboard for deactivating the alarm system upon entry.

Another object of the invention is to provide in the improved electronic control means an additional instruction in the memory of the microcomputer that causes the alarm system to immediately go into a preliminary alarm mode upon entry into the protected zone, whereby a preliminary function is immediately activated, such as turning on a floor lamp, then following a specified period of time, the system will go into the final alarm mode if the proper deactivating code is not correctly entered on the keyboard within the specified period of time.

An additional object of the invention is to provide a convenient means for achieving multi-operational modes for the alarm system.

The equipment for accomplishing these and other objects will be understood best by reference to the attached drawings, in which:

FIG. 3 shows the detailed wiring diagram, together with the identification of the specific commercially available components that were used in building the working model of Applicants' improved inventive system illustrated in FIG. 2.

Figure 1:
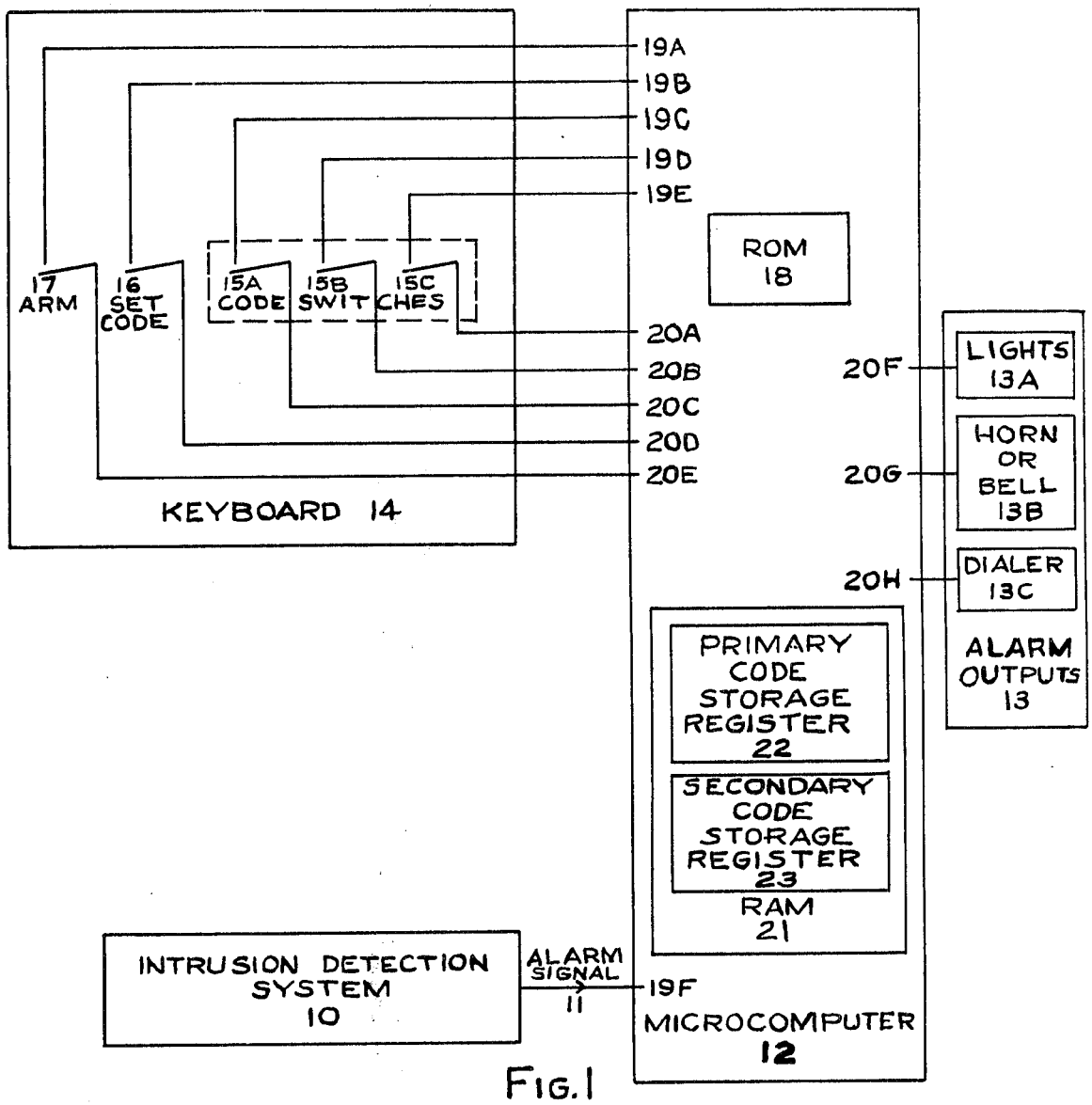
FIG. 1 is a schematic system block diagram showing one illustrative embodiment of the invention.

Referring more particularly to the figures, FIG. 1 shows a system block diagram of one illustrative embodiment of this invention. An intrusion detection system 10 is set up to protect a specified zone such as a room. The intrusion detection system 10 could be any one of the various systems well known in the art, such as, for example, an ultrasonic intrusion alarm system, similar to those described in U.S. Pat. Nos. 3,828,336 and 3,967,260. It could also be a perimeter alarm system employing door and window switches or light beams to secure the premises, such as are also well known in the art. If an intruder enters the zone of detection which is being protected by the intrusion detection system 10, an alarm signal appears at the output of the detection system and is transmitted to the microcomputer 12. A microcomputer is a system well known in the electronic art which contains a microprocessor, a read-only memory (ROM), and a random-access memory (RAM). These could all be contained within a single large-scale integrated (LSI) circuit, as in the case of the TMS-1000 manufactured by Texas Instruments, or the memory could be separate LSI memory circuits which are externally wired to the microprocessor, as is the case with an 8080 microprocessor system manufactured by Intel Corp.

In the disclosure, the term microcomputer will refer to an entire system containing a processor and memory, whether or not the system utilizes a single integrated circuit or several. The alarm signal 11 could be any type of signal as commonly used in the electronic art for transmitting data to a microcomputer. For example, the alarm signal could be a 15 volt DC signal which appears at the output of the detection system 10 when it goes into alarm and which is interpreted as an alarm condition by the microcomputer 12, or the alarm signal 11 could be represented by the closing of a normally open switch, or by the opening of a normally closed switch at the output of the detection system 10 when it goes into alarm, and the change of state of the switch will be interpreted as an alarm condition by the microcomputer.

The microcomputer 12 is programmed to interpret the presence of an alarm signal 11 to mean that an intrusion has occurred in the protected zone and then proceeds to activate any of the alarm outputs 13, in accordance with the instructions programmed i crocomputer system. The alarm outputs 13 m a variety of well-known alarm indicators, suc 13A, horns or bells 13B, telephone dialers, 1

In order for the intrusion alarm system ill FIG. 1 to be functionally practical, means m vided for authorized personnel to activate a vate the system. In the improved inventi herein disclosed, coded electronic activating a vating means are provided, as schematically by the switches shown on keyboard 14. The are shown as normally open switches which m example, push-button switches which close button is pressed and then automatically sp when the force is removed, similar to those touch-tone telephones or electronic calculato The switches on keyboard 14 are connect microcomputer 12 through the five output 20A, 20B, 20C, 20D, and 20E, and the five in nals 19A, 19B, 19C, 19D, and 19E, as illustrat 1. The microcomputer 12 can be made to c monitor the state of the switches on keybo determine what switches are closed and in they have been closed. The sequence of op specific switches on keyboard 14 can then authorized personnel to operate the microco which, in turn, controls the intrusion alarm accordance with the directions programme microcomputer.

For example, the microcomputer 12 ca grammed so that it will not respond to the p the alarm signal until it has been previously the closing of ARM switch 17. In like mann crocomputer 12 can be further programmed will not respond to the closing of the ARM until a proper electronic code has first been e the memory of the microprocessor. The proper code is entered into the microcompu closing the SET CODE switch 16 and then code switches 15A, 15B, and 15C in the desi nation, such as is used in setting a combinatio For illustrative purposes, only three code sw 15B, and 15C are shown; however, in pr number of switches may be used, such as a f display as used on a telephone keyboard.

Any desired code could be entered in crocomputer 12 by any sequence or combin code switches. For example, a valid code co resented by any combination of three closu code switches 15A, 15B, and 15C, such as CAC, or BBB, etc.

To enter a specific code into the memory crocomputer 12, the SET CODE switch closed. The microcomputer detects the clo SET CODE switch 16, which causes the puter to scan the state of code switches 15A 15C. At this point, the particular sequence i three code switches are pressed is stored in t of the microcomputer and establishes the c cific code for operating the system.

After the specific code has been stored in of the microcomputer 12, it is ready to r signal from the ARM switch 17. When the puter detects the closure of ARM switch 17 ready to respond to an alarm signal 11 fro sion detection system 10. The intrusion de tem is now fully activated and any intrusio zone of protection will result in the activation of the alarm outputs 13, as previously discussed.

The alarm system can be deactivated only by authorized personnel who know the electronic code which has been stored in the memory of the microcomputer 12. The microcomputer is programmed to continually scan the code switches 15A, 15B, and 15C. If the identical code which is stored in the memory of the microcomputer is re-entered into the microcomputer by closing the code switches in the proper sequence, the microcomputer will become deactivated and automatically place the system in the STANDBY mode and it will not activate the alarm outputs 13.

The intrusion alarm system will remain in the STANDBY mode until it is armed again by closing the ARM switch 17. While the alarm system is in the STANDBY mode, the code in the memory of the microcomputer can be changed at will by closing the SET CODE switch 16 and pressing any new combination of code switches 15A, 15B, and 15C, as desired. This feature permits the activating and deactivating of the system by authorized personnel by a simple push-button electronic code without the disadvantages of the key method used in prior art systems, as described above.

The microcomputer 12 of FIG. 1 contains all the components of a large-scale digital computer, including inputs, outputs, read-only memory (ROM) 18, random-access memory (RAM) 21, working registers, and an adder/comparitor. There are many types of such microcomputers that are now commercially available, such as Texas Instruments' TMS1000 and Rockwell International's MM76E. Any electronic engineer skilled in the computer art can write a software computer program that, when stored in the ROM 18, will cause the microcomputer 12 to control the desired functions in an intrusion alarm system in the manner described above. The specific details of the microcomputer and its programming and operation are well known in the computer art and are not part of this invention. This invention is in the novel combination of the microcomputer with an alarm system to achieve the improvements herein described.

The software program is entered into the read-only memory (ROM) 18 of the microcomputer 12. The software program in the ROM controls the inputs 19A, 19B–19F and outputs 20A, 20B–20H of the microcomputer 12, as required. For example, a typical method that can be employed for scanning the keyboard 14 to determine if any of the switches are closed is to apply voltages to the outputs 20A, 20B, 20C, 20D, and 20E. Voltages would then appear at the corresponding inputs 19A, 19B, 19C, 19D, or 19E only if the switch on keyboard 14 between the respective input and output terminals were closed.

The order in which data are accepted or acknowledged at the inputs of the microcomputer 12 is also controlled by the software program stored in the ROM 18. For example, when the alarm system of FIG. 1 is first installed and becomes activated, the microcomputer will first require that an electronic code be placed into memory before the system can be armed. Therefore, the software program will not permit the microcomputer to initially respond to the closure of ARM switch 17, but instead it will only respond to the closure of SET CODE switch 16. When a voltage appears at input 19B indicating that SET CODE switch 16 has been closed, the software program permits the microcomputer to check inputs 19C, 19D, and 19E. As the code switches 15A, 15B, and 15C are closed, voltages are applied to the inputs 19C, 19D, and 19E. The sequence in which these voltages are applied is stored in the primary code storage register 22 of the random-access memory (RAM) 21.

Only after a valid code has been entered in the primary code storage register 22 will the software program allow the microcomputer to respond to the closure of ARM switch 17. A voltage appearing at input 19A will then indicate when ARM switch 17 has been closed, and the software program will now allow the microcomputer to respond to an alarm signal 11 when it appears as a voltage at input 19F. The alarm signal 11 will only appear when the intrusion detection system 10 detects the presence of an intruder. Typically, the software program will include a time delay of 30 to 60 seconds after detecting alarm signal 11 before allowing the microcomputer to activate all of the alarm outputs 13.

Once the system is properly armed, the software program will cause the microcomputer to respond to an alarm signal 11 when it appears at input 19F. The microcomputer response activates outputs 20F, 20G, and 20H, which, in turn, activate alarm outputs 13A, 13B, and 13C, as desired. The software program can also establish time delays between the appearance of an alarm signal 11 and the activation of outputs 20F, 20G, and 20H.

The keyboard 14 can be advantageously placed within the zone of detection of the intrusion detection system 10. With the keyboard in this location, any individual, when entering the zone, will activate the intrusion detection system 10, causing the microcomputer to enter into the alarm mode. At this point, the software program will only permit the preliminary alarm outputs, such as the lights 13A to be immediately activated. The other alarm outputs would not be activated until after a time delay of 30 to 60 seconds. This would give an authorized individual sufficient time to deactivate the alarm system before the major alarm outputs, such as the bell 13B and the telephone dialer 13C, are activated. These alarm outputs are activated by signals which appear at the outputs 20G and 20H of the microcomputer if the deactivating code is not correctly entered on the keyboard 14 within the time delay period.

To deactivate the alarm system, the identical code that is stored in the primary code storage register 22 of RAM 21 must be entered by pressing the proper sequence of code switches 15A, 15B, and 15C on keyboard 14. The software program causes the microcomputer to continually scan inputs 19C, 19D, and 19E while it is in the ARM mode. The sequence of voltages appearing at inputs 19C, 19D, and 19E, which correspond to the sequence of code switches 15A, 15B, and 15C, is then stored in the secondary code storage register 23 of the RAM 21. The software program will cause the microcomputer 12 to continually compare the sequence stored in the primary code storage register 22 with the sequence stored in the secondary code storage register 23. When these sequences are identical, the software program causes the microcomputer to enter the STANDBY mode. In the standby mode, the alarm system is deactivated and the microcomputer will no longer respond to the alarm signal 11 appearing at input 19F.

While in the standby mode, the software program will only allow the microcomputer to respond to signals at inputs 19A and 19B. An input voltage appearing at 19A will indicate that the ARM switch 17 has been closed and the microcomputer will go into the ARM mode, as described. A voltage appearing at input 19B while the system is in the STANDBY mode will indicate that the SET CODE switch 16 has been closed. The software program will then cause the microcomputer to scan inputs 19C, 19D, and 19E to detect a new sequence of code switch closures when entered. The new code switch sequence will replace the sequence previously stored in the primary code storage register 22. Thus, an authorized individual can easily change the electronic code for deactivating the alarm system whenever he desires. Presently used key-operated switches cannot have their tumblers conveniently changed. Thus, the replacement of key-operated electrical switches, as now generally used for activating and deactivating the alarm system, by the inventive electronically coded method greatly increases the reliability and security of the intrusion detection system.

Figure 2:
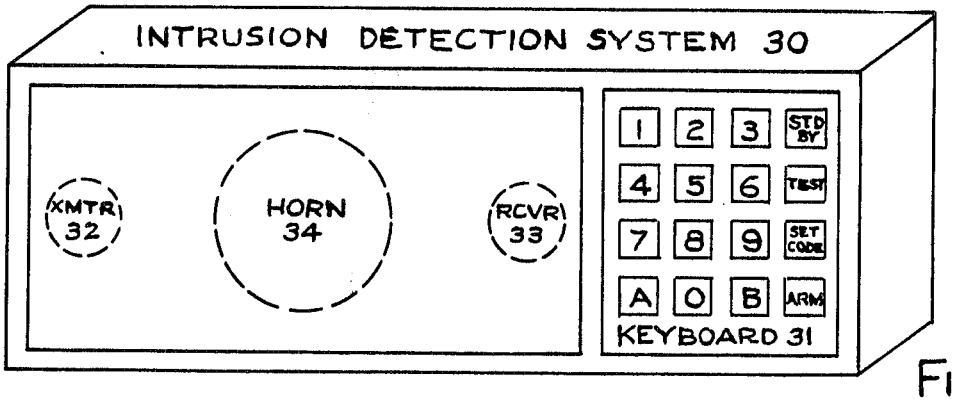
FIG. 2 is a pictorial view of an actual working model of an ultrasonic intrusion detection system built by Applicants incorporating the teachings of this invention, as illustrated in the schematic diagram of FIG. 1.

Applicants have built a working model system employing the teachings of this invention which they incorporated in an intrusion alarm system 30, as illustrated in FIG. 2. The working model of the inventive system was specifically built to control an ultrasonic intrusion detection system employing the teachings of U.S. patent application Ser. No. 683,548, filed May 5, 1976. The keyboard 31 used in the operating model is a standard electronic calculator keyboard, Model TI-11K5107, produced by Texas Instruments. The twelve keys designated by the numbers 0 through 9 and the letters A and B shown on the keyboard 31 of FIG. 2 correspond to the schematic code switches 15A, 15B, and 15C of FIG. 1. The SET CODE key in FIG. 2 is equivalent to the SET CODE switch 16 of FIG. 1 and the ARM key in FIG. 2 is equivalent to the ARM switch 17 of FIG. 1.

The intrusion detection system 30 pictured in FIG. 2 utilizes an ultrasonic transmitting transducer 32 and an ultrasonic receiving transducer 33, and represents the intrusion detection system 10 of FIG. 1, plus the additional control circuits illustrated in FIG. 1. During operation, the transmitting transducer 32 radiates ultrasonic sound into the room, and part of the sound is reflected from objects in the room and returns to the receiving transducer 33. If any of the objects within the insonified area move, the frequency of the sound reflected from the moving objects will change due to Doppler, and the intrusion detection system will detect the change in frequency and transmit an alarm signal to the microcomputer. A more detailed description of the operation of the ultrasonic intrusion detection system 10 is given in U.S. patent application Ser. No. 683,548, filed May 5, 1976.

The TEST key shown on the keyboard 31 in FIG. 2 is in addition to the switches illustrated in keyboard 14 in FIG. 1. It is used to place the alarm system into the TEST mode which permits the alarm system to automatically indicate the extent of its zone of detection. When the TEST key is pressed, the ultrasonic intrusion alarm system 30 will repetitively sample the received ultrasonic signal for one-half second intervals, and if it detects motion, the microcomputer will activate the internal horn 34 shown in FIG. 2 for one-half second. The internal horn 34 is one of the alarm outputs 13 schematically shown in FIG. 1. While in the TEST mode, the intrusion alarm system will produce a one-half second tone beep every second while a person is walking within the zone of detection, thus the extent of coverage within the zone. Wh son leaves the zone of detection, the intern will remain silent; thus the person installing unit which incorporates the inventive system the position and orientation of the intrusion system 30 to provide the desired detection within the area.

FIG. 3 shows the actual schematic wiring the working model of the intrusion alarm s was built by Applicants incorporating the te this invention. An ultrasonic intrusion detect 10A generates an alarm signal 11A, which signal, when an intruder enters the prote Obviously, any other type of intrusion detect other than an ultrasonic system could be use ate an alarm signal 11A upon detecting the an intruder.

The most important component used in t model of the inventive intrusion alarm systen cally illustrated in FIG. 3 is the TM1000 puter 33 (which corresponds to the illus crocomputer 12 of FIG. 1.) The TMS1000 puter 33 contains all of the components of a digital computer on a single chip. It has input and an adder/comparitor. A detailed desc specification of the actual microcomputer u plicants' working model may be found in th *grammer's Reference Manual TMS*1000 *Series One-Chip Microcomputers*, published in 197 Instruments, Inc. Within the microcompu included the primary code storage register ondary code storage register 23, the ROM RAM 21, as illustrated in FIG. 1. The in microcomputer 33 of FIG. 3 are the four te K2, K4, and K8, and the outputs used ar outputs R1, R2, R3, R4, R5, R6, R7, and schematic wiring diagram of FIG. 3, the ac number of each electronic component use The actual pin numbers that are used in th the integrated circuit (IC) chips are also sh schematic by a small number just outside the senting the particular IC. The pin number is to the wire which is attached to the par These pin numbers are not to be confuse reference numbers assigned to the individ nents in FIG. 3.

As shown in FIG. 3, K1, K2, K4, and K8 nals of the microcomputer 33 are connec wires to the keyboard 31 which is a modif Texas Instruments' keyboard #11KS107. T crossings are located below the 16 push- illustrated in the pictorial view of the assem FIG. 2. When a key is pressed, the two wir under the key are electrically connected. T zontal matrix wires from the keyboard 31 ar to the four input terminals K1, K2, K4, an microcomputer 33, and four vertical matr connected to the four output terminals R2, R5, as shown.

When the microcomputer scans the key nals to determine which key is pressed, it applies a voltage to the four terminals R2, R5, and then determines whether there present at any of the four input terminals K K8. If a particular key is pressed, there wi trical connection established between a s combination of output and input termina crocomputer. Therefore, when the scanning voltage is applied to the output terminal which is electrically connected by the pressed key, it will appear at the corresponding input terminal of the micrcomputer 33 which represents the particular key that was pressed.

To sample for an alarm condition, the microcomputer 33 will generate a voltage on its output terminal R1 which is connected to the bilateral switch 35, which is an RCA Model CD4066BE. The output from the ultrasonic detection system 10A is connected to the terminal 8 of the bilateral switch 35. If no alarm condition is present, the potential appearing at terminal 8 will be zero. When an alarm condition is present, a 15 volt alarm signal 11A will appear at terminal 8 of the bilateral switch 35. When the microcomputer 33 produces a voltage at the R1 output terminal, the voltage is applied to terminals 6 and 12 of the bilateral switch 35. When a voltage appears at pins 6 and 12, the potential at terminal 8 is transferred to terminal 9 of the bilateral switch 35. Terminal 9 is connected to the K1 input terminal of the microcomputer 33, as shown. Therefore, when sampling for an alarm condition, the microcomputer 33 applies a voltage to its R1 output terminal. If there is no alarm condition present, the potential at its K1 input will be zero, but, if an alarm condition exists, the 15 volt alarm signal 11A will be transmitted through the bilateral switch 35 to the K1 input of the microcomputer.

Upon sensing an alarm condition, the microcomputer 33 can utilize some of its other output terminals to activate any alarm outputs desired, such as the alarm outputs 13 illustrated in FIG. 1. In the absence of an alarm condition, no voltage is applied to output terminal R6 in FIG. 3. Therefore, 15 V is applied to the light emitting diode 36, as is evident in the schematic wiring diagram. The lighted diode normally indicated that power has been applied to the system. However, when an intrusion is detected, this light will be turned off by the microcomputer because of the appearance of a voltage at the output R6, thereby giving a visual indication of the alarm condition.

Relay 37 is made to change state by the microcomputer 33 in the case of an alarm condition by the appearance of a voltage at the output R7. The relay 37 can then be used to activate any desired alarm outputs, such as the external alarm outputs 13 illustrated in FIG. 1. The internal horn 34 is activated by the appearance of an alternating voltage at the terminal R8 of the microcomputer 33 when an alarm is sensed. The control of all of the various operations of the microcomputer 33 is determined by the software program which is stored in the read-only memory (ROM) of the microcomputer. Power for all of the circuits is supplied by the power supply 39, which is a conventional DC power supply, as is well known in the electronic art.

When power is first applied to the intrusion alarm system, the software program causes all storage registers to be erased, and the system automatically enters the TEST mode. In the TEST mode, the system will sample for the existence of alarm signal 11A. This is done by applying a voltage to the R1 output while monitoring the K1 input. If an alarm condition exists, the program causes a voltage to be applied to output R6 for ½ sec., which shuts off the LED 36 by turning on transistor Q1, as shown in FIG. 3. At the same time, a voltage is also applied to the R8 output, which activates the internal horn 34 for ½ second. The keyboard 31 is then scanned, as directed by the program in the microcomputer, to determine if any of the keys are pressed. If the system does not have a code stored in the primary code storage register within the microcomputer 33, the system will only respond to the SET CODE key. The microcomputer determines when the SET CODE key is pressed by applying a voltage to the output R5 and seeing if a voltage appears at the K4 input terminal. If a code is stored in memory, then the system is programmed to respond only to the STANDBY key, which, when pressed, will produce a voltage at the K1 input terminal when a voltage appears at R5. If no keys are pressed, the program will cause the sampling for an alarm condition to be repeated at one second intervals. Therefore, while in the TEST mode, the system will flash the LED 36 and the internal horn 34 will sound for ½ second every second when there is an alarm condition present.

When the SET CODE key is pressed, the program will cause the microcomputer 33 to scan the alphanumeric portion of the keyboard 31. This is done by the microcomputer sequentially applying voltages to the outputs R2, R3, and R4 and sensing for the appearance of voltages at inputs K1, K2, K4, and K8. When one of the alpha-numeric keys is pressed, the position of the corresponding switch connection in the keyboard matrix is stored in the primary code storage register in the microcomputer. This process is repeated until three successive keys are pressed and their sequential positions in the matrix are stored in the primary code storage register. The SET CODE operation is now completed and the program causes the system to automatically enter the STANDBY mode.

While in the STANDBY mode, the microcomputer will not look for an alarm condition, but instead will apply a voltage to output R5 to determine when either the TEST key, SET CODE key, or the ARM key is pressed. If the TEST key is pressed, the microcomputer is programmed to place the system into the TEST mode, as previously described. However, since there is already a 3-digit code stored in the primary code storage register, the microcomputer will no longer respond to the SET CODE key, as before, but instead it will only respond to the STANDBY key to remove the system from the TEST mode.

If the SET CODE key is pressed while the unit is in the STANDBY mode, the 3-digit code stored in the primary code storage register is erased, and the microcomputer will again scan the alpha-numeric key switches in the keyboard matrix until another 3-digit code has been entered and stored in the primary code register. The system will then re-enter the STANDBY mode.

If the ARM key is pressed, the microcomputer places the system in readiness for intrusion detection. The microcomputer 33 is programmed to do nothing for thirty seconds after the ARM key is pressed. The inactive thirty-second delay period is provided in the program by entering a computation loop which takes thirty seconds to complete. This thirty-second delay will provide sufficient time for an individual to leave the zone of detection after he presses the ARM key before the intrusion alarm system is ready to detect motion in the protected zone.

After a thirty-second exit delay, the microcomputer applies a voltage to output terminal R1 and the input terminal K1 is monitored. If no alarm condition is present, the input K1 will have a zero potential across it. If there is any motion within the zone of detection, such as would occur with the presence of an intruder, the ultrasonic detection system 10A will produce the 15 volt alarm signal 11A. This would be transferred to the K1 input by the bilateral switch 35, and the microcomputer 33 would enter the initial alarm mode. First, an output voltage will appear on the output terminal R1, which is applied to the transistor Q1, causing the LED 36 to turn off. For the next thirty seconds, the alpha-numeric key switches on keyboard 31 are scanned by the microcomputer 33. If a 3-digit code is entered on the keyboard during the thirty-second period, the code is stored in the secondary code storage register in the memory of the microcomputer 33. After each key is pressed, the microcomputer utilizes a comparitor to compare the contents of the primary code storage register with the contents of the secondary code storage register. If the codes stored in both registers are the same, the microcomputer will enter the STANDBY mode and the voltage will be removed from output R6, thereby causing the LED 36 to turn on.

If the code in the secondary code storage register is not equal to the code in the primary code storage register, the microcomputer 33 will keep scanning the code switches until the proper code is entered, or until the thirty seconds have elapsed. At the end of thirty seconds, the final alarm mode is entered, at which point the microcomputer will stop scanning the keyboard alphanumeric matrix and will apply a voltage to both output terminals R7 and R8. The voltage at R7 will cause transistor Q2 to turn on, thereby causing relay 37 to change state. This relay can be used to activate any external alarm device. R8 activates the internal horn 34.

After the system has been in the final alarm, state for a period of four minutes, the voltage is removed from R6, R7, and R8, and the system automatically again enters the ARM mode and is ready again to detect motion in the protected zone. Therefore, once the system is armed in the inventive system, it can only be returned to the STANDBY mode by entering the correct 3-digit code on the keyboard 31.

The inventive system goes into preliminary alarm mode as soon as any one enters the zone of detection. The preliminary alarm mode can be made to perform any desired function, such as turning on a floor lamp to light the way for the authorized person when he enters at night. The authorized person has thirty seconds the enter the proper 3-digit code before the system enters the final alarm mode. Since the keyboard contains more than 1700 possible 3-digit code combinations, an unauthorized intruder would find it virtually impossible to guess the correct code within the thirty seconds the unit is in its preliminary alarm mode. Another advantage of the inventive system is that the code combination can be easily changed by authorized personnel without the inconvenience of changing locks and keys, as is necessary in conventional alarm systems.

The preferred embodiments of this invention have been based on the latest state of the art advances in microcomputer technology. It is understood, however, that any one skilled in the electronic art could produce a customized large-scale integrated circuit (LSI) which would incorporate the basic teachings of this invention without the use of a conventional microcomputer. Therefore, while there have been shown and described several specific embodiments of this invention, it will, of course, be understood that various modifications and alternatives may be made without departing from the true spirit and scope of the invention. Therefore, the appended claims are intended to cover all such modifications and alternative constructions as fall
true spirit and scope.

We claim:

1. In combination in an electronically-co
trusion-alarm system, detection means for
the presence of an intruder within a specifie
protected, alarm signal means, means respo
recognition of the presence of an intruder
protected zone for activating said alarm si
alarm output means responsive to the pres
alarm signal means, means associated wit
tronic system for entering a first arbitrary co
system, a first code storage register for r
identity of said first entered arbitrary code
entering a second arbitrary code into sai
second storage register for retaining the ide
second arbitrary code, comparison means
ing the contents of said first and said sec
registers, means for inhibiting the activat
alarm output means, said inhibiting means c
in that it is operative when said second ar
which is entered into said second storag
identical with said first arbitrary code wh
tered and stored into said first storage regi

2. The invention in claim 1 characterized
intrusion alarm system includes a microco
keyboard for controlling the operating func
intrusion alarm system.

3. The invention in claim 2 further char
that one of said operating functions is a me
ing a unique multi-digit code into the mic
memory by pressing a corresponding uni
keys on said keyboard, said stored mult
characterized in that it will control said mic
to withhold the activation of an alarm fun
intrusion alarm system upon the recognition
ence of an intruder within said protected
stored unique multi-digit code is correctly
said keyboard within a specified short time
the presence of the intruder has been reco

4. The invention in claim 3 further char
that said intrusion alarm system includes t
alarm output means, a first alarm output m
responds immediately upon the recognition
ence of an intruder within the protected
second alarm output means which is delaye
a specified short period from responding to t
of an intruder, and still further characterize
second alarm output means is deactivated if
multidigit code is correctly entered on said

5. The invention in claim 4 further char
that said first alarm output means is an e
bulb which is immediately turned on upon t
of the presence of an intruder.

6. The invention in claim 4 further char
that said second alarm output means inclu
matic telephone dialer for reporting the det
presence of an intruder within the protect

7. The invention in claim 4 further cha
that said second alarm output means incl
intensity sound generator.

8. The invention in claim 2 further cha
that one of said controllable operating f
TEST MODE operation of the intrusion
whereby the installed system will give
indication of the covered zone of protec
person moves throughout the zone.

* * * * *